US010488164B1

(12) United States Patent
Utt

(10) Patent No.: US 10,488,164 B1
(45) Date of Patent: Nov. 26, 2019

(54) FIREARM SYSTEM CONFIGURED TO FIRE A CARTRIDGE OF REDUCED LENGTH

(71) Applicant: Larry Utt, Hazel Green, AL (US)

(72) Inventor: Larry Utt, Hazel Green, AL (US)

( * ) Notice: Subject to any disclaimer, the term of this patent is extended or adjusted under 35 U.S.C. 154(b) by 0 days.

(21) Appl. No.: 15/939,928

(22) Filed: Mar. 29, 2018

(51) Int. Cl.

| | |
|---|---|
| ***F42B 5/26*** | (2006.01) |
| ***F42B 5/32*** | (2006.01) |
| ***F42B 5/02*** | (2006.01) |
| ***F41C 7/00*** | (2006.01) |
| *F41A 9/13* | (2006.01) |

(52) U.S. Cl.
CPC ..... *F42B 5/025* (2013.01); *F41C 7/00* (2013.01); *F41A 9/13* (2013.01)

(58) Field of Classification Search
CPC ..... F42B 5/02; F42B 5/26; F42B 5/28; F42B 5/36; F42B 33/04; F41A 19/57; F41A 19/32; F41A 19/27; F41A 19/13
See application file for complete search history.

(56) References Cited

U.S. PATENT DOCUMENTS 949,063 A * 2/1910 Dorn ..... F42B 5/03 102/438
2,306,551 A * 12/1942 Maroney ..... F42B 5/36 102/430
2,455,603 A * 12/1948 Nichols ..... F42C 1/06 102/245
2,480,100 A * 8/1949 Weiss ..... F41A 3/74 89/26
2,514,422 A * 7/1950 Simpson ..... F42B 5/36 102/470
2,922,341 A * 1/1960 Treat, Jr. ..... F41A 1/04 102/470
2,970,543 A * 2/1961 Duffield ..... F42B 5/36 102/470
3,283,719 A * 11/1966 Grandy ..... F42B 5/02 102/443
3,287,843 A * 11/1966 Moller ..... F41A 19/13 42/16
3,367,112 A * 2/1968 Mainhardt ..... F02K 9/80 102/350
3,429,262 A * 2/1969 Kincheloe ..... F41A 19/22 102/438
3,504,629 A * 4/1970 Mack, Jr. ..... F42B 5/18 102/433

(Continued)

*Primary Examiner* — Derrick R Morgan
(74) *Attorney, Agent, or Firm* — AdamsIP, LLC; Edward Garner; J. Hunter Adams

(57) ABSTRACT

An improved firearm system is provided. The improved firearm system comprises an improved firearm cartridge for use in firearm designed to fire the improved firearm cartridge. The firearm cartridge comprises a projectile substantially seated within a cartridge casing, which reduces the length of the firearm cartridge. The cartridge casing may be modified to accept more than one primer. A firing pin of the firearm may be modified so it may strike each of the primers of the cartridge casing. A bolt body may be modified so that it has two pieces connected by a pin so that it may house the modified firing pin. Because the length of the firearm cartridge is reduced, the length of a magazine that holds firearm cartridges may also be reduced. This allows a handle of the firearm to be moved forward so that the magazine may be inserted through the handle.

15 Claims, 6 Drawing Sheets

(56) References Cited

U.S. PATENT DOCUMENTS 3,516,357 A * 6/1970 Hendricks ..... F42B 5/02 102/470
3,577,923 A * 5/1971 Perkins ..... F42B 5/36 102/202.1
3,786,761 A * 1/1974 Ciccone ..... F42B 5/32 102/471
3,855,900 A * 12/1974 Barr ..... F41A 5/24 102/430
3,861,308 A * 1/1975 Grandy ..... F42B 5/045 102/430
3,874,294 A * 4/1975 Hale ..... F42B 33/001 102/467
4,221,065 A * 9/1980 Curran ..... F41A 19/13 42/59
4,315,462 A * 2/1982 Vollers ..... F42C 19/10 102/204
4,593,598 A * 6/1986 Gunder ..... F42B 33/10 72/352
4,630,341 A * 12/1986 Rohmer ..... F42B 33/04 86/12
4,689,185 A * 8/1987 Lopata ..... F42B 5/32 102/205
4,848,237 A * 7/1989 Zedrosser ..... F42B 5/045 102/471
4,852,457 A * 8/1989 Schlegel ..... F41A 19/58 89/6.5
5,001,962 A * 3/1991 Schlegel ..... F41A 19/58 89/41.06
5,386,780 A * 2/1995 Klein ..... E21B 43/1185 102/275.3
5,544,439 A * 8/1996 Grember ..... F41A 19/59 42/114
5,880,397 A * 3/1999 Crilly ..... F42B 5/02 102/430
6,253,682 B1 * 7/2001 Saxby ..... F42B 5/02 102/430
6,502,514 B1 * 1/2003 Holler ..... F42B 5/36 102/204
7,225,741 B2 * 6/2007 Huffman ..... F42B 5/045 102/433
7,841,279 B2 * 11/2010 Reynolds ..... F42B 5/36 102/469
8,484,876 B2 * 7/2013 Mossberg ..... F41A 9/54 42/70.01
8,850,986 B1 * 10/2014 Alalati ..... F42B 5/02 102/470
9,217,626 B1 * 12/2015 Hajjar ..... F42B 7/04
9,273,941 B2 * 3/2016 Carlson ..... F41A 5/18
9,404,719 B1 * 8/2016 Bowers ..... F42B 5/025
9,429,379 B2 * 8/2016 Fellows ..... F41A 19/27
9,500,451 B2 * 11/2016 Hultman ..... F42B 5/16
9,534,858 B2 * 1/2017 Forbes ..... F42B 5/08
9,618,306 B2 * 4/2017 Hultman ..... F42B 12/20
9,777,981 B1 * 10/2017 Bower ..... A63H 5/04
9,857,151 B2 * 1/2018 Dionne ..... F42C 19/10
2005/0103221 A1 * 5/2005 Saxby ..... F42B 8/02 102/471
2009/0049730 A1 * 2/2009 Caulley ..... F41A 3/22 42/69.02
2010/0282113 A1 * 11/2010 Hanchett ..... F41A 9/00 102/469
2011/0265639 A1 * 11/2011 Darian ..... F41A 3/38 89/191.01
2012/0132099 A1 * 5/2012 Busky ..... C06B 39/00 102/336
2014/0311373 A1 * 10/2014 Crum ..... F42B 12/745 102/518
2014/0318404 A1 * 10/2014 Kerley ..... F42B 5/025 102/469
2016/0018199 A1 * 1/2016 Nemec ..... F42B 5/02 102/439
2016/0238355 A1 * 8/2016 Dionne ..... F42C 19/10
2017/0030692 A1 * 2/2017 Drobockyi ..... F42B 5/285
2017/0122685 A1 * 5/2017 Kolev ..... F41A 3/12
2017/0276463 A1 * 9/2017 Tubb ..... F42B 5/03
2018/0017348 A1 * 1/2018 Brown ..... F41A 3/12

* cited by examiner

FIREARM SYSTEM CONFIGURED TO FIRE A CARTRIDGE OF REDUCED LENGTH

FIELD OF THE INVENTION

The present invention relates generally to an improved firearm system having a firearm cartridge with a reduced length compared to a standard cartridge used for firing a bullet of similar caliber and a modified rifle having a magazine for holding a plurality of the cartridges.

BACKGROUND

There are many types of automatic and semi-automatic rifles currently in use, which may be used by both military personnel as well as civilians. For modern military uses, the generally smaller size and lighter weight of carbine rifles offers an advantage due to the rifle being easier to handle and also more maneuverable in close quarters battle, such as in urban settings. For instance, M4 carbine rifles are commonly used by the United States Armed Forces as a replacement for the M16 assault rifle as a standard issue primary infantry weapon to combat units due to its shorter barrel, which makes the rifle easier to handle for infantrymen. However, a standard M4 is about 33 inches in length with the stock extended and has an empty weight of about 6.5 pounds. Thus, in order to make the rifle lighter and more maneuverable, it would be advantageous to further reduce the length and weight of the rifle. However, simply shortening the barrel length of current M4 models would decrease muzzle velocity and generally reduce ballistic performance, particularly at longer ranges.

A limiting factor in reducing the size of a rifle such as an M4 is a minimum required barrel length as well as the types of firearm cartridges used by such rifles. Firearm cartridges have seen little improvement since the creation of the centerfire round. Today projectiles are seated in a cartridge casing so that the majority of the projectile is outside the open end of the casing. The common perception is that the increased pressure of firearm cartridges having deeply seated projectiles is undesirable. As a result, the length of many rifle rounds is too long for a rifle design where a magazine may be inserted through the handle. This results in an increased length of the rifle since the stock must be longer to compensate for the handle being placed closer to the rear end of the receiver. Because increased rifle length is undesirable in close quarters combat, often times the barrel length is reduced so that the firearm is more suitable for close quarters combat.

Accordingly, a need exists in the art for an improved firearm cartridge and a rifle designed to fire the cartridge so that the length of a rifle may be reduced without decreasing the length of the barrel.

SUMMARY

In one aspect, an improved firearm system is provided. The improved firearm system comprises an improved firearm cartridge for use in an automatic or semi-automatic rifle and an improved rifle for firing the cartridge. The cartridge comprises a projectile substantially secured within a cartridge casing, which will reduced the length of the cartridge. With a smaller cartridge, the size of the magazine required to hold a plurality of cartridges may also be reduced. In turn, due to reduced magazine size, current firearms designed to fire larger rifle projectiles may be modified so that the handle used to fire the rifle may be adapted to accept the magazine therein. This design differs from current AR-15 style rifles, which have separate handle and magazine components.

Preferably, two configurations may be used to reduce the overall length of an AR-15 style rifle. In the first configuration, the handle may remain in its current location and be adapted to accept the magazine therein. In this embodiment, the chamber and other internal components must be moved backward to operably correspond to the new magazine location, which allows the overall length of the rifle to be reduce while maintaining the same barrel length. In the second configuration, the magazine may remain in its present location and be converted into a handle, while the present handle is eliminated. In this embodiment, the current internal trigger mechanism remains in its present location, though the trigger itself is moved forward so that the user may fire the rifle with the same hand that grips the handle. In order to initiate firing by pulling trigger from its new location, an internal extension arm operably connects the newly located trigger to the internal trigger mechanism in its previous location. This embodiment may be advantageous in terms of minimizing changes to currently configured rifles, thereby allowing current rifle designs to be more easily retrofitted with the present modifications.

In either of the above described embodiments, the overall length of the cartridge must be reduced in order to provide a handle and magazine assembly of a size that may feasibly be gripped by a user. To reduce the length of the cartridge, the cartridge comprises a hollow casing having a cylindrical portion and a tapered portion that defines an open end through which the projectile will be projected from the casing. The tapered portion has a continuous cylindrical wall extending inwardly from the open end into an interior of the hollow casing. An exterior surface of the projectile is in face sharing contact with an interior surface of the cylindrical wall such that the projectile is secured to the casing. The cartridge further comprises a propellant, such as gunpowder, which substantially fills the hollow casing, in addition to a rim and primer, as in standard cartridges. However, in the present cartridge, propellant is filled around an exterior surface of the cylindrical wall. Thus, in the present cartridge design, because the portion of the casing that supports the projectile is set inward into the interior of the casing, rather than outward as in known cartridge casings, the overall length of the cartridge is reduced, and propellant is additionally filled in the casing around at least a portion of the projectile (although a portion of the projectile may also extend outwardly from the casing). Thus, the present design reduces cartridge length while also minimizing any loss in propellant capacity due to the reduced length of the cartridge.

The firearm system may also comprise a firearm cartridge comprising at least one cartridge primer. The at least one cartridge primer may comprise a first cartridge primer and a second cartridge primer. Additional primers will help increase the efficiency in which the propellant inside the cartridge casing is deflagrated since current primers are designed to ignite propellant via a single hole through the base of the casing. Additionally, extra cartridge primers will further reduce the chance of a misfire in the firearm. The first cartridge primer may comprise a cylindrical cup, primer mixture, and anvil. The second cartridge primer may surround the first cartridge primer, and may comprise a toroid shaped cup, primer mixture, and anvil. The toroid shaped cup preferably has a rectangular cross section. A firing pin modified to strike any number of cartridge primers may be used to ignite the primer mixture in a way such that it detonates the propellant. In embodiments having more than one cartridge primer, the casing base may be modified from what is currently available so that a user may fire the casing with the desired number of cartridge primers.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DESCRIPTION OF THE DRAWINGS

These and other features, aspects, and advantages of the present invention will become better understood with regard to the following description, appended claims, and accompanying drawings where:

DETAILED DESCRIPTION

Figure 1:
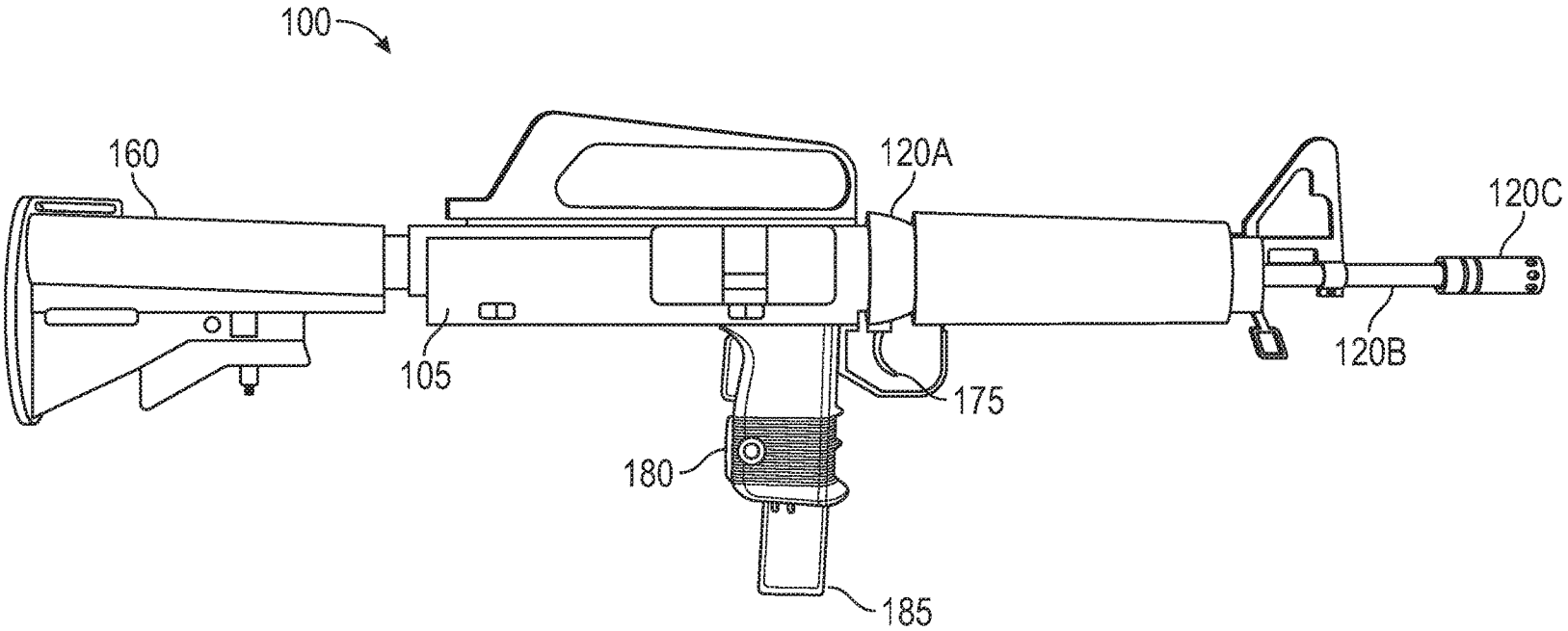
FIG. 1 shows a perspective view of an apparatus embodying features of the present invention.

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, ingredients, steps, etc. are optionally present. For example, an article "comprising" components A, B, and C can contain only components A, B, and C, or can contain not only components A, B, and C, but also one or more other components. As defined herein, the word substantial means more than half of the length. For instance, if a projectile is substantially seated within a cartridge casing, more than half of the length of the projectile is seated within the cartridge casing.

A firearm system 100 comprising a firearm 200 and a firearm cartridge 300 is depicted in FIGS. 1-7. The firearm 200 may comprise a receiver 105, stock 160, barrel 120, trigger mechanism 175, and bolt assembly 700. The firearm cartridge 300 may comprise a cartridge casing 340, casing base 305, at least one cartridge primer 500, propellant 330, and projectile 325. The firearm 200 may be configured to accept the firearm cartridge 300 in a way such that a user may operate the firearm 200 to cause the propellant 330 within the firearm cartridge 300 to deflagrate and propel the projectile 325 out the barrel 120 of the firearm 200.

The receiver 105 may house the internal components of the firearm 200, such as the trigger mechanism 175, bolt assembly 700, and bolt carrier assembly. The receiver 105 may allow a user to attach a barrel 120, stock 160, and handle 180 to the firearm 200. The receiver 105 may have a front receiving end, rear receiving end, bottom receiving end, top receiving end, and two sides. In a preferred embodiment, a user may attach a barrel 120 to the front receiving end, a stock 160 to the rear receiving end, and a handle 180 to the bottom receiving end. In another preferred embodiment, the front receiving end of the receiver 105 may have a female threaded connector for a barrel 120 having a male threaded connector. A user may attach different barrels 120 to the receiver 105 by screwing the male receiving end of the barrel 120 into the female receiving end of the receiver 105. In this way, a user may quickly change barrels 120 of a firearm 200. In yet another preferred embodiment, the stock 160 and handle 180 may attach to the receiver 105 via an attachment mechanism, such as screws or bolts. In one preferred embodiment, the handle 180, stock 160, or barrel 120 may be attached to the receiver 105 in a way such that they may not be removed.

The receiver 105 is preferably made of forged, machined, or stamped steel or aluminum; however, any metal suitable for withstanding high pressures, repetitive motions, and high heats may be used to construct the receiver 105. Alternatively, the receiver 105 may be made of polymers and sintered metal powders. The receiver 105 may be one piece or multiple pieces that may connect together to create an operable firearm 200. For instance, a firearm 200 may have an upper receiver 105B and lower receiver 105A, each made to house different components necessary to create an operable firearm 200. For instance, the upper receiver 105B may house a bolt assembly 700 and a barrel 120 while the lower receiver 105A may house a trigger mechanism 175, stock 160, handle 180, and magazine well. The upper receiver 105B may then be connected to the lower receiver 105A in a way such that they create an operable firearm 200. Alternatively, the upper receiver 105B may be disconnected from the lower receiver 105A for easier cleaning and replacement of faulty components. In another preferred embodiment, an upper receiver 105B and lower receiver 105A may be combined to create different firearm systems 100. For instance, an upper receiver 105B having a gas key 117 may be exchanged for an upper receiver 105B having a gas piston. The lower receiver 105A remains the same, but the change from an upper receiver 105B with a gas key 117 to an upper receiver 105B with a gas piston creates a firearm system 100 with different properties than before.

The receiver 105 may house a bolt assembly 700. The bolt assembly 700 may comprise of a bolt body 110, firing pin 125, and extractor 135. The bolt body 110 may comprise a hammer end, firing pin hole, retaining pin hole, and bolt face. The bolt face of the bolt body 110 may seal the entrance of a chamber 120A holding a firearm cartridge 300. A user may then operate the firearm 200 in a way that may cause a propellant 330 within a firearm cartridge 300 to deflagrate. By sealing the entrance of the chamber 120A, the expanding gasses created by a deflagrated propellant 330 must move out the unsealed end of the chamber 120A, which may propel a projectile 325 out of the firearm 200. In a preferred embodiment, the bolt body 110 may move towards the front receiving end and the rear receiving end of the receiver 105 depending on the direction of the force applied by a user. By applying a force that moves the bolt body 110 towards the front receiving end of the receiver 105, a user may seal the entrance of the chamber 120A with the bolt face, whereas applying a force that moves the bolt body 110 towards the rear receiving end of the receiver 105 may cause the chamber 120A entrance to be unsealed. For instance, a user wanting to seal the chamber 120A may push the bolt body 110 towards the front receiving end until the chamber 120A is sealed, and a user wanting to unseal the chamber 120A may pull the bolt body 110 towards the rear receiving end of the receiver 105 until the chamber 120A is unsealed. Therefore, in one preferred embodiment, the bolt body 110 may have a handle 180 attached so a user may push the bolt body 110 towards the front receiving end to seal the entrance of a chamber 120A and pull the bolt body 110 towards the rear receiving end to unseal the entrance of a chamber 120A.

The bolt body 110 may have firing pin hole bored throughout so that a firing pin 125 may transfer energy to the firearm cartridge 300 and deflagrate the propellant 330. In a preferred embodiment, the firing pin hole may extend from the hammer end to the bolt face of the bolt body 110. Preferably, the firing pin hole is smooth as to allow a firing pin 125 to move within the firing pin hole without catching. As such, the firing pin hole may allow a firing pin 125 to be housed within the bolt body 110 in a way such that it may move within said bolt body 110 so that it may transfer energy to a firearm cartridge 300. In a preferred embodiment, the firing pin hole may allow a firing pin 125 to move in a direction towards the front receiving end or in a direction towards the rear receiving end. In yet another preferred embodiment, the firing pin hole may be centrally located within the bolt body 110.

The user may apply force to the firearm cartridge 300 and deflagrate the propellant 330 via the firing pin 125. In a preferred embodiment, the firing pin 125 may transfer energy from a trigger mechanism 175 to the at least one cartridge primer 500 of the firearm cartridge 300. The firing pin 125 may comprise a rod 127 with a striking end and a punching end, wherein said striking end may be struck in a way such that the firing pin 125 may transfer energy to the at least one cartridge primer 500 via the punching end. In a preferred embodiment, the firing pin 125 may be made of a hardened material in order to reduce the chance of the firing pin 125 bending. In another preferred embodiment, the firing pin 125 may be made of a light weight material to allow for a quicker and more efficient transfer of energy from the firing pin 125 to the at least one cartridge primer 500. For instance, a firing pin 125 made of a titanium alloy may have the qualities of being both hardened and lightweight, whereas a firing pin 125 made of a lightweight polymer may possess the quality of being lightweight but not hardened. In yet another preferred embodiment, the punching end of the firing pin 125 may be rounded. By rounding the punching end of the firing pin 125, a user may ensure the at least one cartridge primer 500 of the firearm cartridge 300 may be indented rather than pierced, which may reduce the chance an at least one cartridge primer 500 may fail to ignite. However, one with skill in the art may appreciate that the firing pin 125 may comprise of any shape and any material that may allow the firing pin 125 to be housed within the bolt body 110 and transfer a force to a firearm cartridge 300 in a way such that the firing pin 125 may deflagrate the propellant 330 of the firearm cartridge 300.

Figure 6:
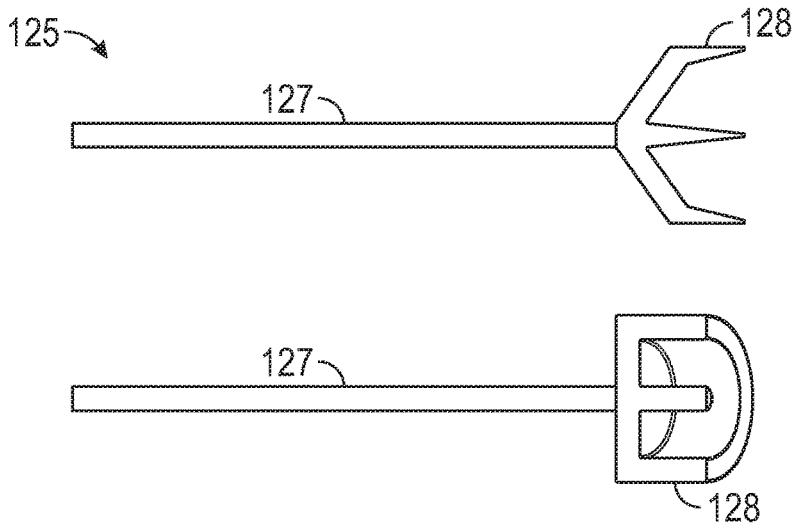
FIG. 6 shows a perspective view of a firing pin embodying features of the present invention.

In a preferred embodiment, as shown in FIG. 6, the firing pin 125 may be configured to strike more than one at least one cartridge primer 500 of a firearm cartridge 300. The firing pin 125 of FIG. 6 comprises a rod 127 and a firing pin head 128, wherein the rod 127 has a striking end and a head end. The firing pin head 128 may be configured to transfer energy to a single cartridge primer or may be configured to transfer energy to multiple cartridge primers. For instance, a firing pin head 128 comprising two prongs may strike two at least one cartridge primers 500 or may be configured to strike a single at least one cartridge primer 500. The firing pin 125 of FIG. 6 may be configured to strike both the first cartridge primer 315 and the second cartridge primer 310. The firing pin head 128 of FIG. 6 may comprise three prongs and may be configured to strike the first cartridge primer 315 in one spot and the second cartridge primer 310 in two spots. As such, the firing pin head 128 of FIGS. 6 and 7 may comprise of two or more prongs and may be configured to strike as many at least one cartridge primers 500 as necessary to deflagrate the propellant 330.

Figure 7:
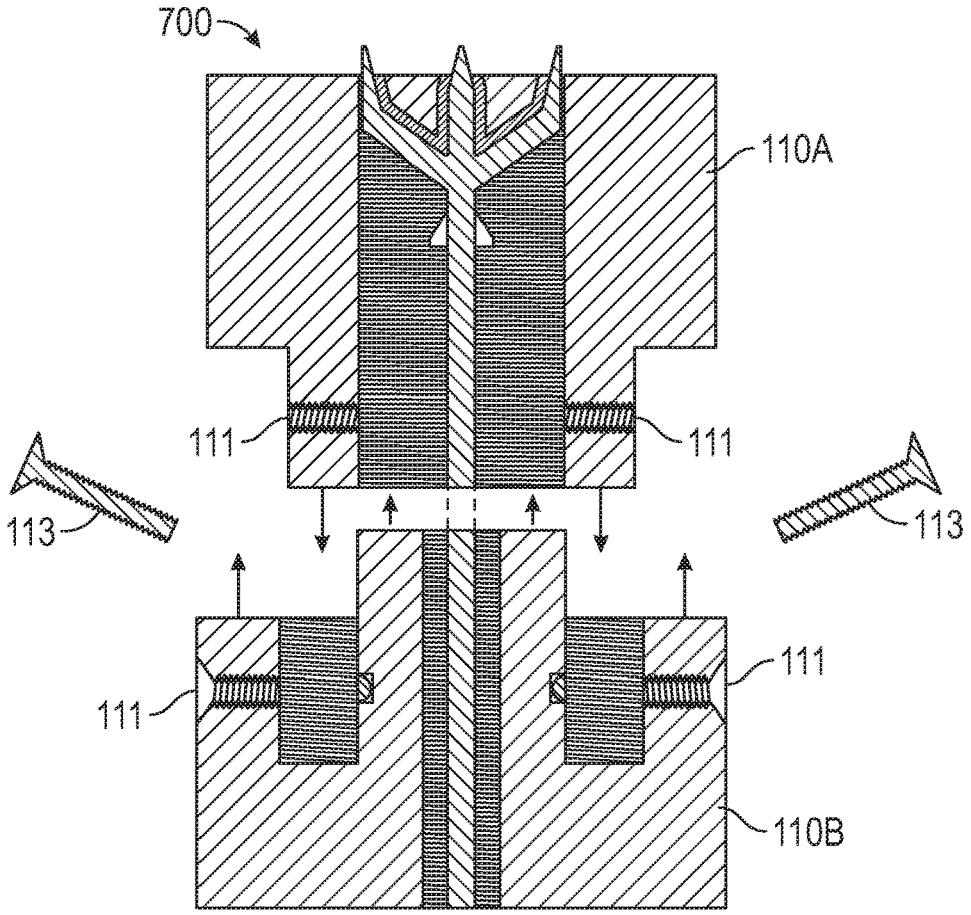
FIG. 7 shows a cross sectional view of a bolt assembly and a firing pin embodying features of the present invention.

In a preferred embodiment, the firing pin 125 may be held in place by a retaining pin 130. The retaining pin 130 may be inserted into the bolt carrier assembly via a retaining pin hole extending from an exterior surface to an interior surface of the bolt carrier 115. The retaining pin 130 may interact with the firing pin 125 in a way such that the firing pin 125 may move towards the front receiving end and back receiving end of the receiver 105 within the bolt body 110 and bolt carrier assembly but may not be fully removed from the bolt body 110 and bolt carrier assembly unless the retaining pin 130 is removed from the bolt carrier 115. Additionally, the firing pin 125 of FIGS. 6 and 7 calls for further modification of the extractor 135 and bolt body 110, which may further hold the firing pin 125 in place within the bolt body 110 and bolt carrier assembly. As seen in FIG. 7, the bolt body 110 may comprise at least two pieces 110A, 110B that may connect and disconnect so that a rod 127 and head 128 of a firing pin 125 may be inserted into the bolt body 110. In a preferred embodiment, the bolt face may further comprise prong holes bored throughout that allow the prongs of the head 128 to project out the bolt face of the bolt body 110, thus allowing the prongs to make contact with the at least one cartridge primer 500 of a firearm cartridge 300. In another preferred embodiment, as illustrated in FIG. 7, the at least two pieces 110A, 110B of the bolt body 110 may have male and female connectors that are held together by bolt pins 113, wherein the bolt pins 113 may be inserted through bolt pin holes 111 the at least two pieces 110A, 110B of the bolt body 110. By removing the bolt pins 113 from the bolt pin holes 111, a user may quickly take apart the at least two pieces 110A, 110B of the bolt body 110 to remove the firing pin 125.

The firing pin 125 may be floating or spring-loaded. The only force acting on a firing pin 125 that is floating is the force transferred to the firing pin 125 from the user. Though the bolt body 110 may be stopped by the firearm cartridge 300 and chamber 120A, a floating firing pin 125 may continue to move forward within the bolt body 110 due to its own inertia. If the firing pin's 125 momentum is great enough, the propellant 330 in the firearm cartridge 300 may be deflagrated by the firing pin 125 striking the at least one cartridge primer 500. To lessen the possibility of an unintentional deflagration of the propellant 330, the firing pin 125 may be constructed of a lightweight material. Alternatively, the bolt assembly 700 may further comprise a firing pin spring to make the firing pin 125 spring-loaded. The firing pin spring may be positioned within the bolt body 110 in a way such that the firing pin spring forces the firing pin 125 away from the at least one cartridge primer 500. In a preferred embodiment, the firing pin spring may be weak enough to not significantly impede the transfer of energy from the hammer to the at least one cartridge primer 500 but strong enough to counter the inertia of the firing pin 125 as it moves forward within the bolt body 110. In this way, the firing pin 125 may only contact the at least one cartridge primer 500 when a force is applied to the firing pin 125 via a component, such as a hammer.

In a preferred embodiment, an extractor 135 may be attached to the bolt face end of the bolt body 110 via an extractor pin 140. The extractor 135 may comprise a gripper and an extractor spring. The gripper may be shaped to fit into a groove on an exterior surface of the firearm cartridge 300 made between the casing base 305 and the hollow casing 320. In one preferred embodiment, the gripper may be shaped to fit the entire groove on the exterior surface of the firearm cartridge 300. In another preferred embodiment, the gripper may be shaped to fit less than the entire groove on the exterior surface of the firearm cartridge 300. As the bolt assembly 700 and bolt carrier assembly move towards the front receiving end of the receiver 105, a firearm cartridge 300 may be stripped from a magazine 185 and inserted into the chamber 120A by the bolt body. As the firearm cartridge 300 is pushed into the chamber 120A by the bolt body 110 via the bolt face, the extractor spring may force the gripper in a position to make contact with the groove on the exterior surface of the firearm cartridge 300 in a way such that the gripper effectively grabs the firearm cartridge 300. By applying a force to the bolt assembly 700 in a direction towards the rear receiving end, a user may cause the extractor 135 to remove the firearm cartridge 300 from the chamber 120A.

In another preferred embodiment, an ejector 137 may be housed within the bolt body 110 through the bolt face. The ejector 137 may comprise an ejector pin and an ejector spring. The ejector spring may exert enough force on the ejector pin so that the ejector pin protrudes from the bolt face. When the bolt body 110 is pushed forward and strips a firearm cartridge 300 from a magazine 185, enough force is exerted on the ejector spring and ejector pin to cause the ejector pin to recede into the bolt body 110. The ejector pin may remain within the bolt body 110 so long as the firearm cartridge 300 is in the chamber 120A. When a force exerted on the bolt body 110 moves the bolt body 110 towards the rear receiving end of the receiver 105, the force of the ejector spring on the ejector pin may push the spent firearm cartridge 300 off of the bolt face of the bolt body 110. In a preferred embodiment, the ejector 137 may be located on the bolt face on a side opposite the location of the extractor 135. By pushing on the bottom of the opposite side of the firearm cartridge 300 as the extractor 135 is grabbing, the ejector 137 may cause the spent firearm cartridge 300 to be slung to the side, thus removing the spent firearm cartridge 300 from the firearm 200.

To provide the force needed to cause the firing pin 125 to forcibly strike the at least one cartridge primer 500, a trigger mechanism 175 may be used. The trigger mechanism 175 may comprise a trigger locking mechanism operably connected to a trigger 175 and hammer. The hammer may be held by the trigger locking mechanism in a position giving the hammer enough potential energy to cause the firing pin 125 to strike the at least one cartridge primer 500 with enough energy that it may cause the at least one cartridge primer 500 to ignite. In a preferred embodiment, when a user pulls the trigger 175, the trigger locking mechanism may be released, which may release the hammer. The trigger mechanism 175 may be a single action mechanism or a double action mechanism. In single action mechanism, the trigger 175 only releases the trigger locking mechanism to allow the hammer to strike the firing pin 125. In order for the hammer to be in a position to have enough potential energy to cause the firing pin 125 to ignite the at least one cartridge primer 500, the hammer may be placed in position by the user or by the motion of the bolt body 110. For instance, a user may apply a force to the hammer in a way that provides the hammer with enough potential energy to cause the at least one cartridge primer 500 to ignite if struck. Alternatively, a force applied to the bolt body 110, causing the bolt body to move towards the rear receiving end of the receiver 105, may move the hammer in a position with enough potential energy to cause the at least one cartridge primer 500 to ignite if struck. Once the hammer has been placed in a position with enough potential energy to ignite the at least one cartridge primer 500, the trigger locking mechanism may hold the hammer in place until the trigger locking mechanism is disengaged by force applied to the trigger 175 via the user.

In a double action mechanism, the trigger 175 may be operably connected to the hammer in a way such that force applied to the trigger 175 may place the hammer in a position with enough potential energy to ignite the at least one cartridge primer 500. Additional force applied to the trigger 175 may then release the trigger locking mechanism holding the hammer, causing the hammer to strike the firing pin 125 in a way such that the at least one cartridge primer 500 may be ignited. In one embodiment of a double action mechanism, the hammer may be locked in position by the trigger locking mechanism once it reaches a position with enough potential energy to cause the hammer to strike the firing pin 125 and cause the at least one cartridge primer 500 to ignite. Therefore, to make the hammer strike the firing pin 125 and cause the at least one cartridge primer 500 to ignite, a user must only provide enough force to the trigger 175 to cause the trigger locking mechanism to release the hammer. In another embodiment of a double action mechanism, there may be no trigger locking mechanism to hold the hammer in place. Therefore, a user must always apply the same force to the trigger 175 cause the hammer to strike the firing pin 125 with enough force to cause the at least one cartridge primer 500 to ignite. In yet another preferred embodiment of a double action mechanism, a user may apply the initial force necessary to the trigger 175 that may place a hammer in a position with enough potential energy to ignite the at least one cartridge primer 500, but the hammer may be subsequently placed in position with enough potential energy to ignite the at least one cartridge primer 500 by the motion of the bolt body 110 caused by the deflagration of the propellant 330 within the firearm cartridge 300.

As mentioned previously, the barrel 120 may be connected to the receiver 105 at the front receiving end. The barrel 120 may comprise of a bore 120B, chamber 120A, and muzzle 120C. The bore 120B may be an elongated portion of the barrel 120 made of a hardened material comprising a chamber end and muzzle end. The bore 120B may have a borehole extending from the chamber end to a muzzle end, wherein the borehole may be configured to allow a projectile 325 from a firearm cartridge 300 to pass from the chamber end to the muzzle end. In a preferred embodiment, the borehole diameter and dimensional uniformity is the same from the chamber end to the receiving end.

In another preferred embodiment, the barrel 120 may withstand pressures greater than 100,000 pounds per square inch (psi). In yet another preferred embodiment, the barrel 120 may be made of machined steel alloy, carbon fiber, or a combination thereof; however, one with skill in the art may appreciate that the barrel 120 may comprise of any material that may allow the barrel 120 to withstand pressures of greater than 100,000 psi.

The barrel 120 may be configured in a way such that the firearm cartridge 300 may be inserted into the barrel 120 via the chamber 120A. The chamber 120A is preferably connected to the chamber end of the bore 120B and may be configured to house a firearm cartridge 300 of a particular size so that the firearm cartridge 300 fits snuggly within the chamber 120A. Upon insertion of a firearm cartridge 300 into the chamber 120A, a portion of the projectile 325 may be inserted into the chamber end of the bore 120B. In a preferred embodiment, a projectile 325 may be inserted up to five millimeters (mm) within the chamber end of the bore 120B when a firearm cartridge 300 is inserted into the chamber 120A. As the projectile 325 passes through the bore 120B via the borehole, the projectile 325 may gain speed due to the buildup of gasses from the deflagration of the propellant 330 within the chamber 120A. In another preferred embodiment, the borehole may have the same circumference as the projectile 325 so the buildup of gasses behind the projectile 325 is increased, thus increasing the pressure behind the projectile 325 and effectively increasing the velocity of the projectile 325 as it passes through the bore 120B via the borehole. In yet another preferred embodiment, the muzzle end of the borehole may have helical grooves carved into the sides to cause the projectile 325 to spin as it exits the muzzle end. Preferably, the helical grooves may cause the projectile 325 to perform a full revolution once every seven inches it travels.

Figure 2A:
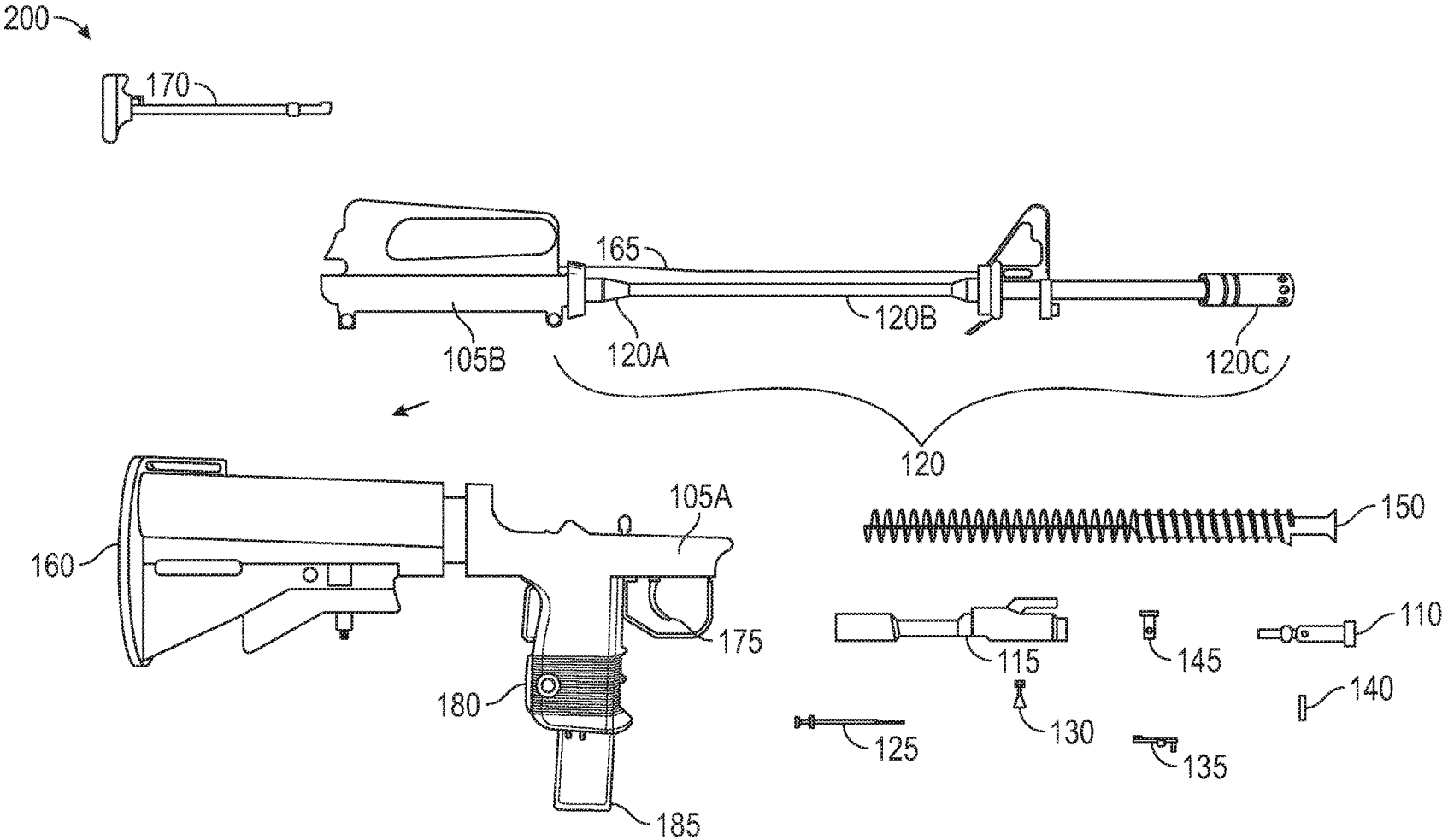
FIG. 2A shows a exploded view of a firearm embodying features of the present invention.
Figure 2B:
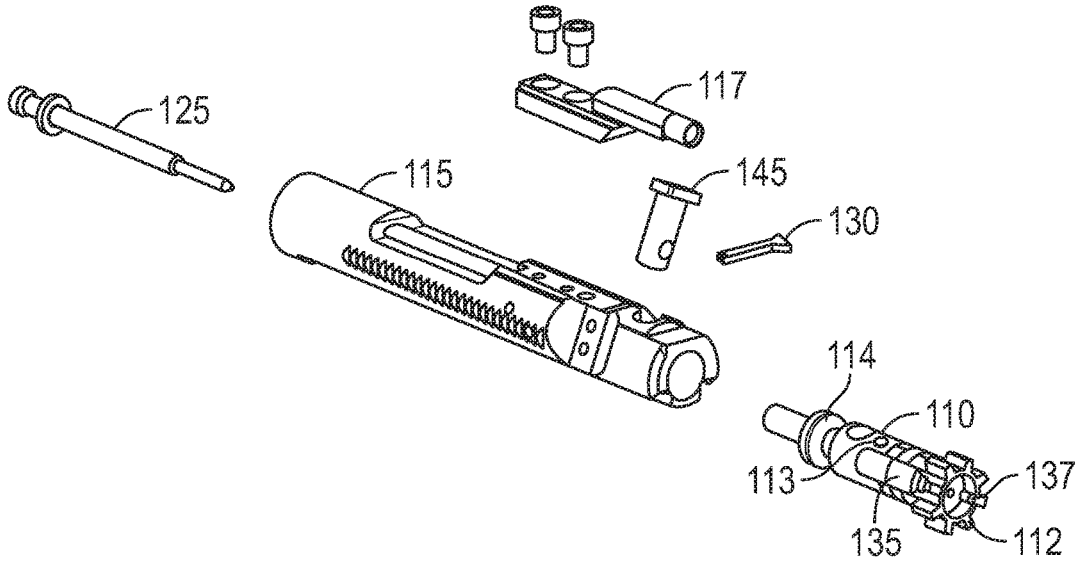
FIG. 2B shows a exploded view of a firearm embodying features of the present invention.
Figure 3A:
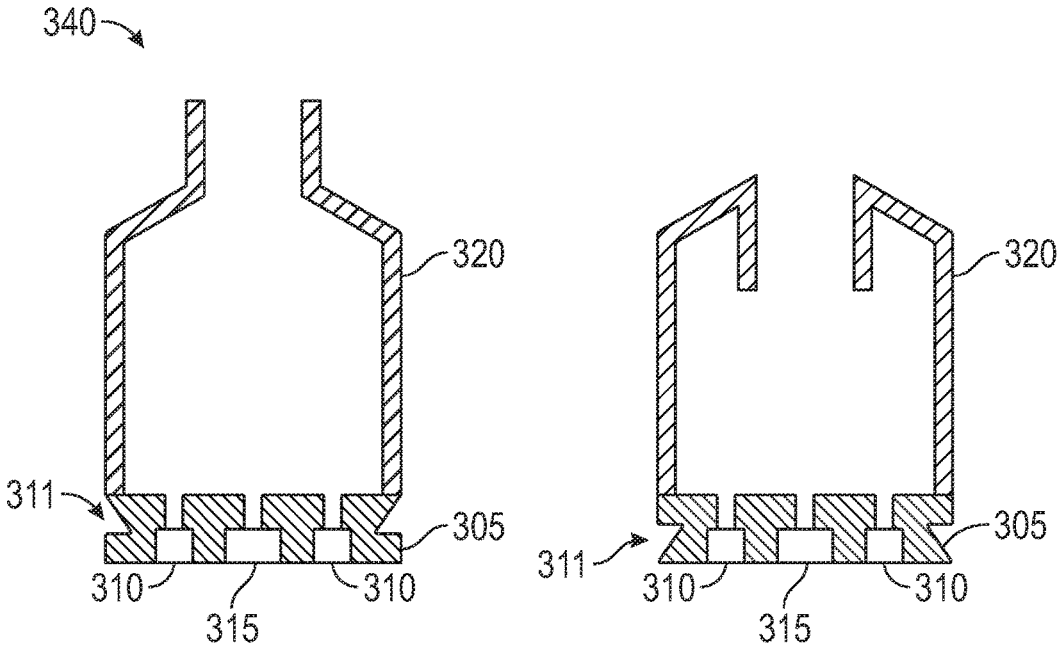
FIG. 3A shows a cross sectional view of a cartridge casing embodying features of the present invention.
Figure 3B:
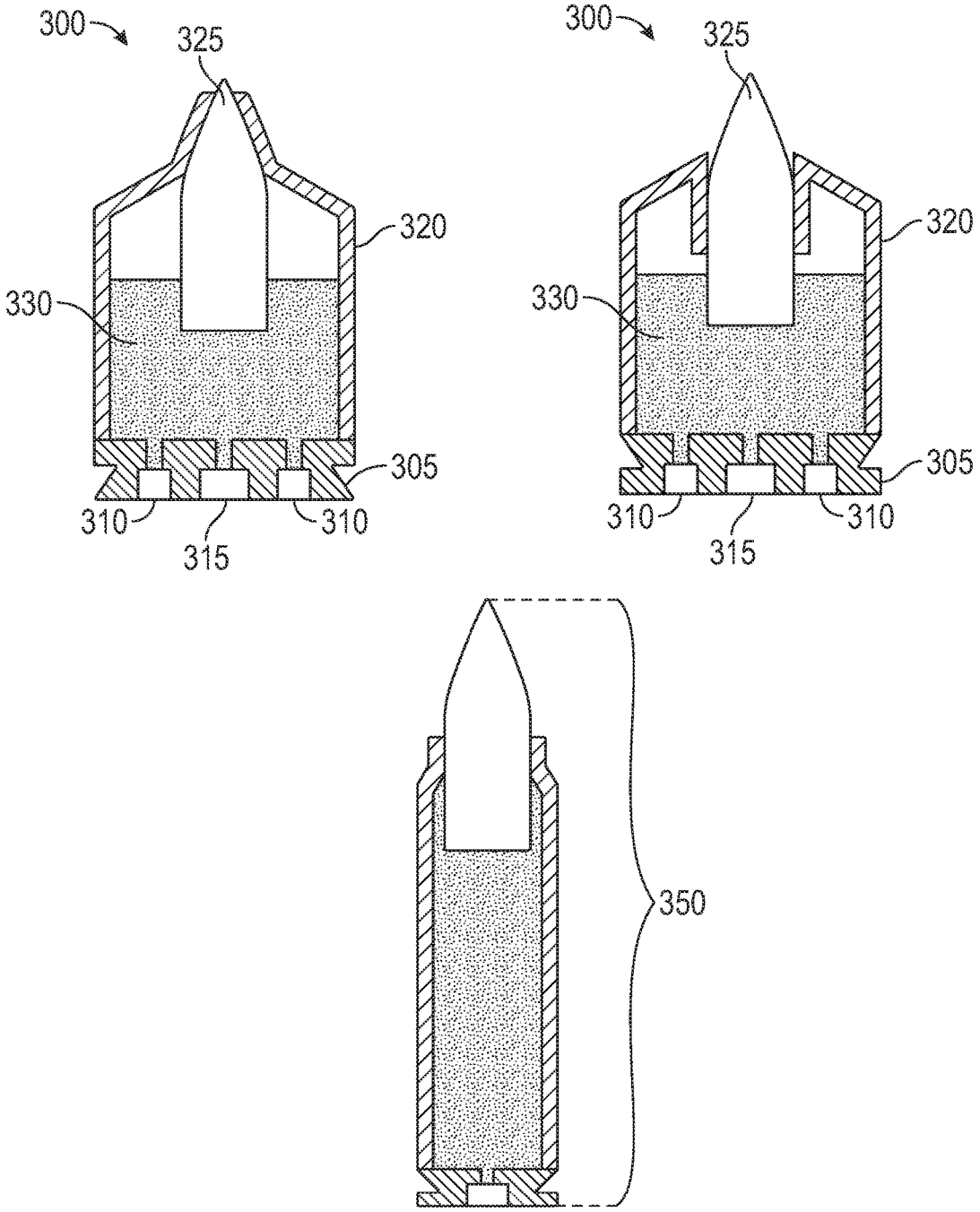
FIG. 3B shows a cross sectional view of a firearm cartridge embodying features of the present invention.

In a preferred embodiment, the firearm 200 may further comprise a bolt carrier assembly. The bolt carrier assembly may house the bolt assembly 700 within the receiver 105 and may comprise a bolt carrier 115, gas key 117, gas rings 114, retaining pin 130, and cam bolt 145. In a preferred embodiment, the bolt carrier assembly may move towards the rear receiving end and the front receiving end of the receiver 105 via force provided by expanding gases. As depicted in FIG. 2, the bolt carrier 115 may be configured to house the bolt assembly 700 in a way such that the bolt body 110 may move towards the rear receiving end and front receiving end of the receiver 105 within the bolt carrier 115. When a firearm cartridge 300 is within the chamber 120A, the bolt carrier 115 allows the bolt assembly 700 to move towards the front receiving end of the receiver in a way such that the bolt body 110 seals the chamber 120A. When a user deflagrates the propellant 330 within a firearm cartridge 300, the bolt carrier assembly allows the bolt assembly 700 to move towards the rear receiving end of the receiver 105 in a way such that the bolt body 110 unseals the chamber 120A.

In order to remove the firearm cartridge 300 from the chamber 120A, the bolt assembly 700 and bolt carrier assembly must move towards the rear receiving end of the receiver 105. A force may be applied the bolt assembly 700 and bolt carrier assembly by the user via a charging handle 170 or by some other means such as recoil caused by the deflagration of the propellant 330, expanding gasses released as the propellant 330 reacts within the chamber, or by a gas driven piston. In a preferred embodiment, a gas hole extending from the exterior surface of the barrel 120 to the borehole may allow gas to be transferred from the bore 120B to the receiver 105. A gas key 117 may be connected to the bolt carrier 115, and a gas tube 165 may be inserted into the gas key 117, wherein the gas tube 165 extends from the gas hole of the barrel 120 to the gas key 117. In this way, expanding gases may be transferred from the barrel 120 to the bolt carrier assembly via the gas tube 165 and gas key 117. As the expanding gasses interact with the bolt carrier assembly and the bolt assembly 700, the expanding gasses may push the bolt carrier assembly towards the rear receiving end of the receiver 105. In a preferred embodiment, as the bolt carrier assembly is pushed towards the rear receiving end of the receiver 105, a chamber locking mechanism 112 of the bolt assembly 700 and chamber 120A disengages, allowing the bolt assembly 700 and bolt carrier assembly to move towards the rear receiving end of the receiver 105. As the bolt carrier assembly and bolt assembly 700 move towards the rear receiving end, the gas key 117 may disconnect from the gas tube 165, venting any excess expanding gas.

In a preferred embodiment, gas rings 114 may be attached to the tail end of the bolt body 110 in a way such that they create a seal within the bolt carrier assembly. The gas key 117 may be connected to the bolt carrier 115 in a way such that the expanding gasses enter on the rear receiving end side of the gas rings 114. As expanding gasses are transferred to the bolt carrier 115 by the gas key 117, the seal created by the gas rings 114 forces the bolt carrier 115 towards the rear receiving end of the receiver 105. As the bolt carrier 115 moves towards the rear receiving end, a cam bolt 145 causes the bolt body 110 to rotate, disengaging the chamber locking mechanism 112 between the bolt body 110 and the chamber 120A. The expanding gasses then force the bolt carrier assembly and the bolt assembly 700 towards the rear receiving end of the receiver 105, thus unsealing the chamber 120A and disconnecting the gas key 117 from the gas tube 165. In embodiments further comprising an extractor 135, the extractor 135 may remove the spent firearm cartridge 300 from the chamber 120A as the bolt assembly 700 and bolt carrier assembly move towards the rear receiving end. In embodiments further comprising an ejector 137, the ejector 137 may remove the spent firearm cartridge 300 from the bolt face, effectively removing the spent firearm cartridge 300 from the firearm 200.

To prevent the bolt assembly 700 from disconnecting from the bolt carrier assembly, a cam bolt 145 may be used to connect the bolt body 110 to the bolt carrier 115. In a preferred embodiment, the cam bolt 145 may connect to the bolt body 110 through a cam bolt slit of the bolt carrier 115. In a preferred embodiment, the cam bolt slit may be of a length that allows the bolt body 110 connected to a cam bolt 145 to slide towards the rear receiving end and front receiving end of the receiver 105 but not so far as to allow the bolt body 110 to disconnect from the bolt carrier 115. In one preferred embodiment, the cam bolt slit may be at an angle so that movement of the bolt assembly 700 within the bolt carrier 115 may cause the bolt body 110 to rotate around a central axis. In a preferred embodiment, the entrance of the chamber 120A and the bolt face may have a chamber locking mechanism 112 that allows the bolt body 110 to seal and lock the chamber 120A. As the bolt body 110 moves forward within the bolt carrier 115, the cam bolt 145 may cause the bolt body 110 to rotate. As the chamber locking mechanism 112 of the bolt body 110 makes contact with the chamber locking mechanism 112 of the chamber 120A, the rotation of the bolt body 110, due to the cam bolt 145 and cam bolt slit, causes the chamber locking mechanisms 112 to engage, thus sealing and locking the chamber 120A.

The firearm 200 depicted in FIG. 2 may further comprise a recoil spring 150. When the bolt assembly 700 and bolt carrier assembly have been forced towards the rear receiving end of the receiver 105 by expanding gasses or by a gas piston, the recoil spring 150 may slow the recoiling assemblies and return them to the chamber 120A. If the recoil spring 150 is too weak, the recoiling assemblies may batter the receiver 105 of the firearm 200 and cause damage. A weak recoil spring 150 may also lack the force to bring the bolt face back into contact with the chamber 120A so that the chamber 120A may be sealed by the chamber locking mechanism 112. On the other hand, a recoil spring 150 that is too strong may cause the firearm 200 to jam or short-stroke, meaning the bolt did not move far enough towards the rear receiving end to strip a firearm cartridge 300 from a magazine 185 on its way back towards the front receiving end. Therefore, in the preferred embodiment, the recoil spring 150 is strong enough to slow the recoiling assemblies but light enough to prevent jams and short-strokes. As the assemblies move towards the chamber end of the receiver 105, the assemblies may strip a new firearm cartridge 300 from the magazine 185. The assemblies may then push the firearm cartridge 300 into the chamber 120A and seal the chamber 120A so that another firearm cartridge 300 may be fired by the user.

The firearm system 100 may also comprise a firearm cartridge 300 comprising at least one cartridge primer 500, casing base 305, hollow casing 320, propellant 330, and projectile 325. In the preferred embodiment depicted in FIG. 5, the at least one cartridge primer 500 may comprise a first cartridge primer 315 and a second cartridge primer 310. The first cartridge primer 315 may comprise a cylindrical cup 317, a primer mixture 505, and an anvil 515. In another preferred embodiment, the first cartridge primer 315 may further comprise a sealing material 510 disposed between said cylindrical cup 317 and said primer mixture 505. The cylindrical cup 317 may comprise a cylindrical base, first interior sidewall, and first exterior sidewall. The primer mixture 505 may be disposed on the cylindrical base of the cylindrical cup 317 in a way such that the primer mixture 505 is interposed between the lower surface of the anvil 515 and the cylindrical base of the cylindrical cup 317. The anvil 515 of the first cartridge primer 315 may be located in the cylindrical cup 317 and may comprise of an upper surface, lower surface, and side surface. In a preferred embodiment, the sidewall may connect the anvil 515 to the inner sidewall of the cylindrical cup 317 in a way such that the anvil 515 is affixed to the cylindrical cup 317. Alternatively, the anvil 515 may not be connected to the cylindrical cup 317 via the sidewall. In another preferred embodiment, the lower surface of the anvil 515 is protruded towards the cylindrical base of the cylindrical cup 317. A striking surface may be formed with a portion of the cylindrical base of the cylindrical cup, wherein the striking surface is adjacent to a portion of the primer mixture 505 that is interposed between the lower surface of the anvil 515 and the cylindrical base of the cylindrical cup 317. In this way, striking the exterior surface of the cylindrical cup 317 may cause the anvil 515 to ignite the primer mixture 505.

Figure 4:
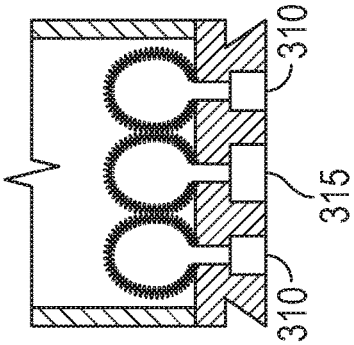
FIG. 4 shows a perspective view of a casing base embodying features of the present invention.
Figure 4:
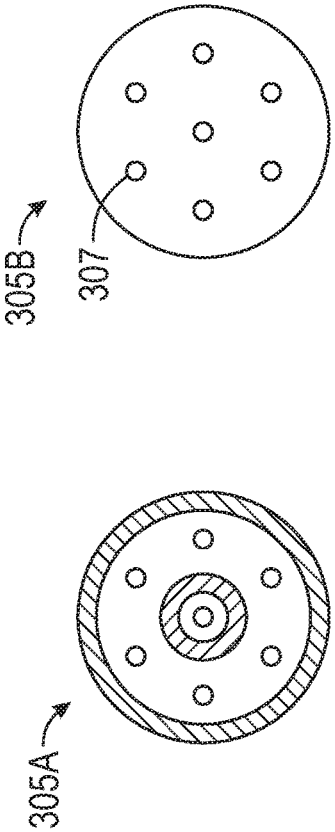
Figure 5:
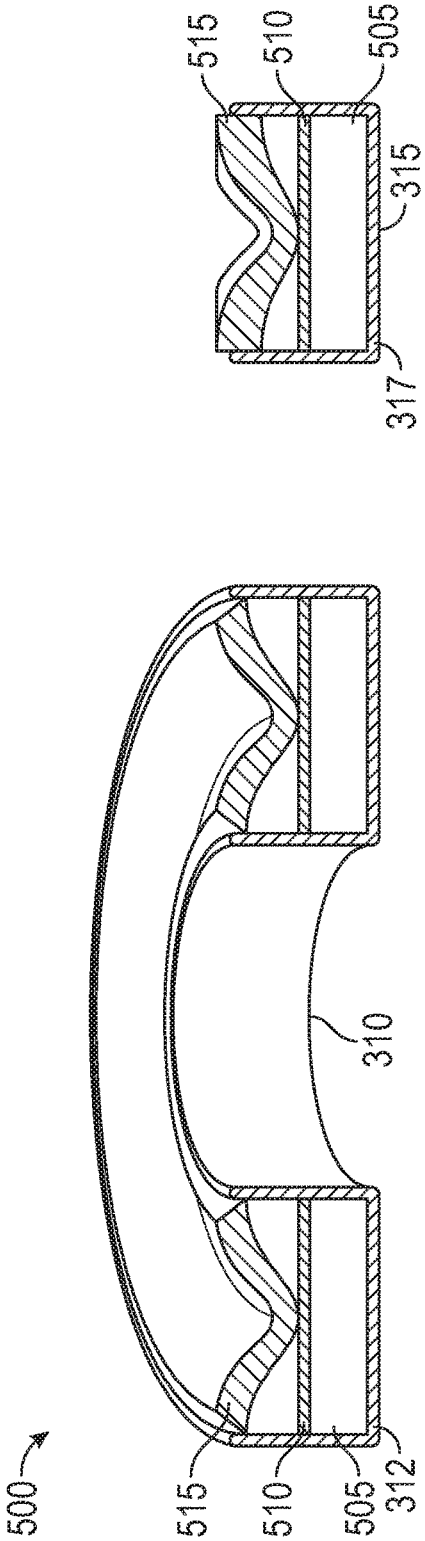
FIG. 5 shows a cross sectional view of an at least one primer embodying features of the present invention.

As shown in FIGS. 3A-5, the second cartridge primer 310 may surround the first cartridge primer 315. In a preferred embodiment, the second cartridge primer 310 may comprise a toroid shaped cup 312, primer mixture 505, and anvil 515. In another preferred embodiment, the second cartridge primer 310 may further comprise a sealing material 510 disposed between said toroid shaped cup 312 and said primer mixture 505. The toroid shaped cup 312 may comprise a toroid shaped base, inner sidewall, and exterior sidewall. The primer mixture 505 may be disposed on the toroid shaped base of the toroid shaped cup 312 in a way such that the primer mixture 505 is interposed between the lower surface of the anvil 515 and the toroid shaped base of the toroid shaped cup 312. The anvil 515 of the second cartridge primer 310 may be located in the toroid shaped cup 312 and may comprise of an upper surface, lower surface, and side surface. In a preferred embodiment, the anvil 515 of the second cartridge primer 310 may be a ring shape. The sidewall may connect the anvil 515 to the inner sidewall of the toroid shaped cup 312 in a way such that the anvil 515 is affixed to the toroid shaped cup 312. Alternatively, the anvil 515 is not connected to the toroid shaped cup 312 via the sidewall. In another preferred embodiment, the lower surface of anvil 515 is protruded towards the toroid shaped base of the toroid shaped cup 312. A striking surface may be formed with a portion of the toroid shaped base of the toroid shaped cup 312, wherein the striking surface is adjacent to a portion of the primer mixture 505 that is interposed between the lower surface of the anvil 515 and the toroid shaped base of the toroid shaped cup 312. In this way, striking the exterior surface of the toroid shaped cup 312 may cause the anvil 515 to ignite the primer mixture 505. In a preferred embodiment as depicted in FIG. 5, the toroid shaped cup 312 has a rectangular cross section.

The casing base 305 may comprise a top surface 305B, bottom surface 305A, and a sidewall. The bottom surface 305A of the casing base 305 may be configured to accept an at least one cartridge primer. In the preferred embodiment, as shown in FIG. 4, the casing base 305 is configured to hold the first cartridge primer 315 and the second cartridge primer 310. The casing base 305 may further comprise at least one hole 307 extending through the casing base 305 from the top surface 305B to the bottom surface 305A. When a user operates the firearm 200 in a way to cause the hammer to strike the firing pin 125, the firing pin 125 may subsequently strike the first exterior surface of the first cartridge primer 315 and the second exterior surface of the second cartridge primer 310 held within said casing base 305. This may cause the striking surface of the first cartridge primer 315 and second cartridge primer 310 to engage the lower surface of their respective anvil 515, thus igniting the adjacent primer mixtures 505 held within the toroid shaped cup 312 and cylindrical cup 317. The at least one hole 307 allows the ignited primer mixtures 505 of the first cartridge primer 315 and second cartridge primer 310 to move from the bottom surface 305A to the top surface 305B of the casing base 305.

The hollow casing 320 may attach to the casing base 305 in a way such that together the casing base 305 and hollow casing 320 create a cartridge casing 340. The exterior surface of the cartridge casing 340 may have a groove 311 where the casing base 305 and hollow casing 320 connect. The hollow casing 320 may comprise a cylindrical portion that defines a bottom end and a tapered portion that defines a top end. The bottom end of the hollow casing 320 may connect to the casing base 305, effectively closing the bottom end. In a preferred embodiment, the top end of the hollow casing 320 may remain open so that the cartridge casing 340 may be filled with propellant 330 and a projectile 325. In another preferred embodiment, the tapered portion may have a continuous cylindrical wall extending outwardly from the open top end to the cylindrical portion. The cylindrical portion may have a continuous cylindrical wall extending vertically from said tapered portion to said casing base 305.

In a preferred embodiment, the cartridge casing 340 has a base diameter of about 0.476 centimeters (cm) or the diameter of the casing base of 0.45 ACP cartridge. The shoulder width of the cartridge casing 340 may be 0.447 cm or approximately ninety three percent of the width of the casing base, as it is in a standard 5.56×45 mm NATO cartridge 350. The cartridge casing 340 preferably may have a height of approximately 3.82 cm or approximately two thirds the height of a standard 5.56×45 mm NATO cartridge 350. The neck diameter of the cartridge casing 340 of the preferred embodiment may depend of the width of the projectile. Additionally, the neck diameter of the cartridge casing 340 of the preferred embodiment may be tapered depending on how deeply seated the projectile is within the cartridge casing 340. However, one with skill in the art will appreciate that the cartridge casing 340 may comprise of any base diameter, shoulder width, height, and neck diameter that will allow a projectile substantially seated within the cartridge casing 340 to be expelled from a firearm 200.

As mentioned previously, a projectile 325 may be placed substantially within the firearm cartridge 300 through the open end of the cartridge casing 340. Preferably, a portion of the tip end of the projectile 325 is projected out the open end of the cartridge casing 340, but the projectile 325 may be seated within the cartridge casing 340 in a way so that it does not project out the open end of the cartridge casing 340. In a preferred embodiment, the projectile 325 may comprise a tubular portion that defines a base end, narrowing portion that defines a tip end, and an exterior surface. In a preferred embodiment, the projectile 325 is a standard 5.56×45 NATO projectile with a tip end projecting out of the open end of the cartridge casing 340 no more than five millimeters. In yet another preferred embodiment, the exterior surface of the projectile 325 is in contact with the continuous cylindrical wall of the hollow casing 320 in a way such that the projectile 325 is secured within the cartridge casing 340. Preferably, the exterior surface of the projectile 325 and the continuous cylindrical wall create a seal that allows pressure to build as propellant 330 deflagrates within the cartridge casing 340 and chamber 120A.

As mention previously, the cartridge casing 340 may be substantially filled with a propellant 330 that deflagrates upon ignition of the at least one cartridge primer 500. Upon deflagration of the propellant 330, the interior of the firearm cartridge 300 may fill with hot gas. As the gas expands, pressure may build within the casing. Because the projectile 325 is substantially seated within the cartridge casing 340, more pressure may build behind the projectile 325 than what is normally possible in a standard 5.56×45 mm NATO cartridge 350. This higher pressure may lead to the expulsion of a projectile 325 from the cartridge casing 340 and through the borehole of the barrel 120 at a higher rate of speed than a projectile 325 of a standard 5.56×45 NATO cartridge 350. Because higher pressures may result in the firearm cartridge 300 of the present disclosure than in more traditional firearm cartridges 300, a user may use less propellant 330 to obtain higher projectile 325 velocities. Additionally, the lower amount of propellant 330 may create a larger amount of unfilled space within the cartridge casing 340 for the propellant 330 to react. This may increase the efficiency in which propellants 330 deflagrate within the cartridge casing 340 and the chamber of the barrel 120.

By substantially seating the projectile 325 within the cartridge casing 340, the overall length of a firearm cartridge 300 may be decreased as well as the amount of propellant 330 needed to fire the projectile 325 at a higher rate of speed. This is due to the increased amount of pressure created by seating the projectile 325 deeper within the cartridge casing 340. For instance, a standard 5.56×45 mm NATO cartridge 350 may have an average overall length of 5.74 cm and a casing rated to withstand approximately 62,366 psi pressure created by deflagration of about 23.7 grams of Winchester 748 smokeless propellant 330. The firearm cartridge 300 of the preferred embodiment may have an average overall length of about 3.92 cm and may have a cartridge casing 340 rated to withstand more than 100,000 psi pressure created by deflagration of same amount of propellant 330. The projectile 325 of the firearm cartridge 300 of the preferred embodiment may reach an exit velocity from the muzzle end of the barrel 120 that is higher than that of the exit velocity of a projectile 325 for a standard 5.56×45 mm NATO cartridge 350 due to the higher pressures. By decreasing the amount of propellant 330 within the cartridge casing 340 of the present disclosure, a firearm cartridge 300 with an exit velocity similar to that of a standard 5.56×45 mm NATO cartridge 350 may be created. However, one with skill in the art will recognize that the firearm cartridges 300 having a projectile 325 substantially seated within a cartridge casing 340 may comprise a number of dimensions within without departing from the inventive subject matter as disclosed herein.

Additionally, because the overall length of the firearm cartridge 300 of the preferred embodiment may be reduced by substantially seating the projectile 325 within the cartridge casing 340, a handle 180 may be adapted to accept a magazine 185 in a way such that a user may still grip the handle 180. In a preferred embodiment, the handle 180 may be connected to the bottom end of the receiver 105 in a way such that the handle 180 is generally at an angle between forty-five degrees and ninety degrees with the receiver. In another preferred embodiment, the handle 180 may be attached to the receiver 105 in a way such that it is closer to the rear receiving end of the receiver 105 than the front receiving end of the receiver. In this preferred embodiment, as illustrated in FIG. 2, the bolt assembly 700 and bolt carrier assembly may be moved towards the rear receiving end within the receiver 105 so that the bolt assembly 700 and bolt carrier assembly may receive a firearm cartridge 300 from the magazine 185. Additionally, by moving the bolt assembly 700 and bolt carrier assembly towards the rear receiving end of the receiver 105, the overall length of the receiver 105 may be reduced, which may decrease overall length of the firearm 200 without reducing the length of the barrel 120.

In another preferred embodiment, as illustrated in FIG. 1, the handle 180 may be attached to the receiver 105 in a way such that the handle 180 is closer to the front receiving end than the rear receiving end of the receiver 105. In this embodiment, the trigger locking mechanism and hammer of the trigger mechanism 175 may remain in a location closer to the rear receiving end of the receiver 105, but the trigger itself may be moved forward to the location of the handle 180 so that a user may fire the firearm 200 with the same hand that grips the handle 180. In order to initiate ignition of the at least one cartridge primer 500 by pulling the trigger 175 from its new location, an internal extension arm may operably connect the trigger to the trigger locking mechanism. Additionally, because the magazine 185 may provide the bolt assembly 700 and bolt carrier assembly firearm cartridges 300 from the same location before the modification of the handle 180, this embodiment may be advantageous in terms of minimizing changes to currently configured rifles, thereby allowing current rifle designs to be more easily retrofitted with the present modifications. In yet another preferred embodiment, the stock 160 connected to the receiver 105 may be shortened without decreasing the distance between butt end of the stock 160 and the handle 180. This may allow the overall length of the firearm 200 to be reduced without reducing the length of the barrel 120 or decreasing the ergonomics of the firearm 200.

The magazine 185 of the preferred embodiment may be configured to accept one or more of the firearm cartridges 300 and may connect to the firearm 200 in a way such that the magazine 185 may provide the firearm cartridges 300 to the bolt assembly 700 and bolt carrier assembly via the handle 180. In a preferred embodiment, the magazine 185 may comprise of case, guide, bottom plate, platform, and magazine spring. The case protects the firearm cartridges 300 and holds them in place so that the firearm 200 may provide the chamber 120A with a firearm cartridge 300. The platform holds the firearm cartridges 300 in position within the case in a way such that the firearm cartridges 300 may be provided to the chamber 120A. The guide may push the firearm cartridges 300 through the case to the firearm 200. The magazine spring pushes the guide in a way such that as a firearm cartridge 300 is stripped from the magazine 185 by the firearm 200, the remaining firearm cartridges 300 are pushed in a position to be stripped by the firearm 200 from the magazine 185. In a preferred embodiment, the magazine 185 is a box magazine, but it may also be a tubular, drum, rotary, pan, or helical magazine. In a preferred embodiment, the firearm cartridges 300 may stack in a single row within the magazine 185, but one with skill in the art will recognize that the firearm cartridges 300 may stack within the magazine 185 in any manner without departing from the inventive subject matter as disclosed herein.

The implementations set forth in the foregoing description do not represent all implementations consistent with the subject matter described herein but are examples consistent with the disclosed subject matter. Although variations have been described in detail above, other modifications or additions may be possible. In particular, further features and/or variations may be provided in addition to those set forth herein. For example, the implementations described above may be directed to various combinations and subcombinations of the disclosed features and/or combinations and subcombinations of several further features disclosed above. In addition, the logic flow depicted in the accompanying figures and/or described herein do not necessarily require the particular order shown, or sequential order, to achieve desirable results. It will be readily understood to those skilled in the art that various other changes in the details, materials, and arrangements of the parts and method stages which have been described and illustrated in order to explain the nature of this inventive subject matter may be made without departing from the principles and scope of the present disclosure.

What is claimed is:

1. A firearm cartridge comprising:

a first cartridge primer comprising:

a cylindrical cup having a first base, first interior sidewall, and first exterior sidewall;

a first primer mixture located in said cylindrical cup and disposed on said first base;

a first anvil located in said cylindrical cup, said first anvil comprising:

a first upper surface, a first lower surface, wherein said first lower surface of said first anvil is protruded towards said first base of said cylindrical cup, a first side surface abutting said first inner sidewall; and a second cartridge primer surrounding said first cartridge primer, said second cartridge primer comprising, a toroid shaped cup having a second base, second inner sidewall, and second exterior sidewall, a second primer mixture located in said toroid shaped cup and disposed on said second base, a second anvil having a ring shape and located in said toroid shaped cup, said second anvil comprising, a second upper surface, a second lower surface, wherein said second lower surface of said second anvil is protruded towards said second base of said second cartridge primer, a second side surface abutting said second inner sidewall, a first striking surface formed with a portion of said first base, wherein said first striking surface is adjacent to a portion of said first primer mixture that is interposed between said first lower surface of said first anvil and said first base of said cylindrical cup, wherein said first striking surface is centrally located in said cylindrical cup;

a second striking surface formed with a portion of said second base, wherein said second striking surface is adjacent to a portion of said second primer mixture that is interposed between said second lower surface of said second anvil and said second base of said toroid shaped cup, wherein said second striking surface is located along a central line of said toroid shaped cup, a casing base having a top surface and a bottom surface, wherein said bottom surface is configured to accept said first cartridge primer and said second cartridge primer, wherein striking a first exterior surface of said first cartridge primer causes said first striking surface to engage said first lower surface of said first anvil causing said first primer mixture to ignite and striking a second exterior surface of said second cartridge primer causes said second striking surface to engage said second lower surface of said second anvil causing said second primer mixture to ignite, wherein at least one hole extends through said casing base from said top surface to said bottom surface, allowing said first primer mixture and said second primer mixture, ignited from striking said first exterior surface and said second exterior surface, to move from said bottom surface to said top surface of said casing base;

a hollow casing comprising a cylindrical portion that extends upwardly from said casing base, a tapered portion that extends inwardly from said cylindrical portion, and an inner cylindrical portion that extends from said tapered portion towards said casing base, wherein said tapered portion and said inner cylindrical portion define an open end, wherein said inner cylindrical portion has said continuous cylindrical wall extending downward from said open end towards said casing base, wherein said tapered portion has a continuous cylindrical wall extending outwardly from said open end to said cylindrical portion, wherein said cylindrical portion has said continuous cylindrical wall extending vertically from said tapered portion to said casing base, wherein said hollow casing is substantially filled with said propellant that deflagrates upon ignition of said first cartridge primer and said second cartridge primer;

a projectile having a tubular portion that defines a base end, a narrowing portion that defines said tip end, and a projectile surface, wherein said projectile surface is in contact with said continuous cylindrical wall of said inner cylindrical portion in a way such that said projectile is secured within said hollow casing, wherein said tip end of said projectile is projected out of said open end of said hollow casing.

2. The firearm cartridge of claim 1, wherein said tip end of said projectile is projected out said open end of said hollow casing by not more than five millimeters.

3. The firearm cartridge of claim 1, wherein said toroid shaped cup has a rectangular cross section.

4. The firearm cartridge of claim 1, wherein said first cartridge primer and said second cartridge primer are removable in a way such that said first cartridge primer and said second cartridge primer are replaceable.

5. The firearm cartridge of claim 1, further comprising a sealing material disposed between said first priming material and said first anvil and said second priming material and said second anvil.

6. A casing base comprising:

a first cartridge primer comprising:

a cylindrical cup having a first base, first interior sidewall, and first exterior sidewall;

a first primer mixture located in said cylindrical cup and disposed on said first base;

a first anvil located in said cylindrical cup, said first anvil comprising:

a first upper surface, a first lower surface, wherein said first lower surface of said first anvil is protruded towards said first base of said cylindrical cup, and a first side surface abutting said first inner sidewall; and a second cartridge primer surrounding said first cartridge primer, said second cartridge primer comprising, a toroid shaped cup having a second base, second inner sidewall, and second exterior sidewall, a second primer mixture located in said toroid shaped cup and disposed on said second base, a second anvil having a ring shape and located in said toroid shaped cup, said second anvil comprising, a second upper surface, a second lower surface, wherein said second lower surface of said second anvil is protruded towards said second base of said second cartridge primer, a second side surface abutting said second inner sidewall, a first striking surface formed with a portion of said first base, wherein said first striking surface is adjacent to a portion of said first primer mixture that is interposed between said first lower surface of said first anvil and said first base of said cylindrical cup, wherein said first striking surface is centrally located in said cylindrical cup, a second striking surface formed with a portion of said second base, wherein said second striking surface is adjacent to a portion of said second primer mixture that is interposed between said second lower surface of said second anvil and said second base of said toroid shaped cup, wherein said second striking surface is located along a central line of said toroid shaped cup, a casing base having a top surface and a bottom surface, wherein said bottom surface is configured to accept said first cartridge primer and said second cartridge primer, wherein striking a first exterior surface of said first cartridge primer causes said first striking surface to engage said first lower surface of said first anvil causing said first primer mixture to ignite and striking a second exterior surface of said second cartridge primer causes said second striking surface to engage said second lower surface of said second anvil causing said second primer mixture to ignite, wherein at least one hole extends through said casing base from said top surface to said bottom surface, allowing said first primer mixture and said second primer mixture, ignited from striking said first exterior surface and said second exterior surface, to move from said bottom surface to said top surface of said casing base.

7. The casing base of claim 6, wherein said toroid shaped cup has a rectangular cross section.

8. The casing base of claim 6, further comprising a sealing material disposed between said first priming material and said first anvil.

9. The casing base of claim 6, further comprising:

a hollow casing comprising a cylindrical portion that extends upwardly from said casing base, a tapered portion that extends inwardly from said cylindrical portion, and an inner cylindrical portion wherein said tapered portion and said inner cylindrical portion define an open end, wherein said inner cylindrical portion has said continuous cylindrical wall extending downward from said open end towards said casing base, wherein said tapered portion has a continuous cylindrical wall extending outwardly from said inner cylindrical portion to said cylindrical portion, wherein said cylindrical portion has said continuous cylindrical wall extending vertically from said tapered portion to said casing base.

10. The cartridge primer of claim 6, wherein said first cartridge primer and said second cartridge primer are removable from said casing base in a way such that said first cartridge primer and said second cartridge primer are replaceable.

11. The casing base of claim 6, wherein said cylindrical cup has a rectangular cross section.

12. The casing base of claim 6, further comprising a sealing material disposed between said second priming material and said second anvil.

13. The casing base of claim 9, further comprising a propellant, wherein said hollow casing is substantially filled with said propellant that deflagrates upon ignition of said first cartridge primer and said second cartridge primer.

14. The casing base of claim 9, further comprising a propellant, wherein said hollow casing is substantially filled with said propellant that deflagrates upon ignition of said first cartridge primer and said second cartridge primer.

15. The casing base of claim 14, further comprising a projectile having a tubular portion that defines a base end, a narrowing portion that defines said tip end, and a projectile surface, wherein said projectile surface is in contact with said continuous cylindrical wall of said inner cylindrical portion in a way such that said projectile is secured within said hollow casing, wherein said tip end of said projectile is projected out of said open end of said hollow casing, and wherein said projectile is substantially seated within said hollow casing.

* * * * *